United States Patent [19]

Hudson, deceased et al.

[11] Patent Number: 4,457,049

[45] Date of Patent: Jul. 3, 1984

[54] METHOD FOR TRAINING GIN SAWS AND GINNING RIBS FOR COTTON GINS

[76] Inventors: Bobby D. Hudson, deceased, late of Chandler, Ariz., by Bobby J. Hudson, Administratrix, Chandler, Ariz. 95224

[21] Appl. No.: 526,432

[22] Filed: Aug. 25, 1983

Related U.S. Application Data

[62] Division of Ser. No. 317,303, Nov. 2, 1981, Pat. No. 4,400,851.

[51] Int. Cl.[3] ..... D01B 1/08

[52] U.S. Cl. ..... 19/48 R; 19/55 R; 19/63

[58] Field of Search ..... 19/39, 48 R, 55 R, 63

[56] References Cited

U.S. PATENT DOCUMENTS

| | | | |
|---|---|---|---|
| 2,192,690 | 3/1940 | Morgan | 19/55 R |
| 2,197,932 | 4/1940 | Jones | 19/55 R |
| 2,838,803 | 6/1958 | Banks | 19/55 R |
| 3,490,101 | 1/1970 | Fountain | 19/55 R |

*Primary Examiner*—Louis Rimrodt

*Attorney, Agent, or Firm*—Cahill, Sutton & Thomas

[57] ABSTRACT

A method for training a gin saw assembly and a ginning rib assembly that have been removed from a cotton gin includes a telescoping stand on which the gin saw assembly, including its bearings is temporarily mounted. The apparatus includes an adjustable template with alignment marks with which the individual gin saw blades are manually aligned. The apparatus also includes mounting elements by means of which the ginning rib assembly can be mounted adjacent to the gin saw assembly after the gin saw blades have been trained. The telescoping stand is then extended so that the gin saw blades extend into narrow gaps between the individual ginning ribs in substantially the same relation thereto as when the gin saw assembly and ginning rib assembly are operating in the cotton gin. The individual ribs are then adjusted so that the gin saw blades are precisely centrally positioned in the gaps. The ginning rib assembly and the gin saw assembly then are removed from the training apparatus and reinstalled in the cotton gin.

9 Claims, 6 Drawing Figures

METHOD FOR TRAINING GIN SAWS AND GINNING RIBS FOR COTTON GINS

This is a divisional application of copending Ser. No. 317,303 filed Nov. 2, 1981, now U.S. Pat. No. 4,400,851, granted Aug. 30, 1983.

BACKGROUND OF THE INVENTION

The invention relates to apparatus and methods for training (i.e., adjusting) gin saw assemblies and ginning rib assemblies of cotton gins to improve the operating efficiency of cotton gins.

Cotton gins, which are briefly described hereinafter with reference to FIG. 1, include gin saw assemblies containing a large number of spaced parallel gin saw blades that extend precisely between the ginning ribs of a ginning rib assembly. Optimum efficiency of operation of a cotton gin requires that the individual gin saw blades be perfectly aligned in the spaces between the ginning ribs in order to minimize friction between the gin saw blades and the cotton being ginnned and improve the efficiency of the ginning process. It is also essential to optimum efficiency operation of a cotton gin that the gin saw blades be sharp. The blades of a cotton gin ordinarily become dull and misaligned, relative to the ginning ribs, at least once per season. The dull gin saw blades must be replaced once or twice per season. Replacement of the gin saw blades requires removal of the entire gin saw assembly from the cotton gin. After the gin saw blades have been replaced, or "stacked", it is necessary that they be precisely aligned to correct any misalignment, warpage or the like that may have occurred. Typically, the individual ginning ribs are also out of alignment after a season of ginning. In the past, the manual alignment or training of gin saw blades has been a very painstaking, laborious process involving slight bending of portions of individual gin saw blades using a bifurcated "training" tool and positioning of thin shims between certain gin saw blades and the spacers therebetween, in order to adjust or train the individual gin saw blades so that they are all perfectly spaced and perfectly parallel to their axes of rotation. A template, usually supplied by the manufacturer of the cotton gin, is manually used to check alignment of the gin saw blades. After adjustment, as described above, the gin saw assembly and ginning rib assembly are re-installed in the cotton gin and checked for proper alignment. In most instances, the desired accuracy of alignment has not been achieved on the first try, and numerous repetitive steps of removal, readjusting and re-installing the gin saw assembly, and the ginning rib assembly are required before the desired accuracy of alignment is attained. Typically, this process has required an average of approximately four days for a worker skilled in training gin saws and ginning ribs. This is an excessive amount of time, especially if the need to replace the gin saws and/or train them arises during the ginning season, during which time a cotton gin should be operating as nearly as possible to twenty-four hours per day. A four day interruption during the ginning season obviously represents a serious loss to the owner of the cotton gin, and great inconvenience cost to cotton farmers, who have a limited number of trailers in which harvested cotton is hauled from the cotton harvester to the cotton gin. (If the cotton gin operation must be halted, the trailers remain full, and the cotton harvesting stops.) Yet, despite the "down time" that may be necessary in order to replace and train a gin saw assembly, it is essential that this "down time" be incurred, if the gin saws and ginning ribs become seriously misaligned, due, for example, to ingesting of a large, hard metal object or a piece of wire or the like. This is because the operating efficiency of a cotton gin whose gin saws and ginning ribs are badly misaligned can be reduced by as much as thirty per cent or more. Furthermore, the increased amount of friction that usually accompanies badly misaligned gin saw blades and ginning ribs can generate a great deal of heat that sometimes leads to fires in a cotton gin.

Several years ago, I invented a gin saw training stand that included a pedestal on which an entire gin saw assembly, including its bearings, could be mounted after being removed from a cotton gin. The device included a pivotable rib template that allowed me to position the template immediately adjacent to the edges of the individual blades of the gin saw assembly so that each individual blade could be aligned precisely with calibration marks on the template. I could then slowly rotate the gin saw blade assembly by hand, utilizing a typical forked gin saw training tool to aid in alignment of misaligned, warped blades. The use of this device enabled me to reduce the amount of time required to train one gin saw blade assembly from four days to one-half of a day. Although this was a great improvement over the previous methods of training gin saw blade assemblies, the problem remained that even though the gin saw blade assembly would be perfectly aligned when reinstalled in the cotton gin, the ginning ribs of the ginning rib assembly usually are also out of alignment, and up to now, there has been no practical means (other than trial and error removal, adjustment, re-installation and checking of alignment) of accurately adjusting the ginning ribs relative to the blades of the gin saw blade assembly.

Accordingly, it is an object of the present invention to provide an apparatus and method that facilitates precise and rapid training or adjustment of both gin saw blade assemblies and ginning rib assemblies.

It is another object of the invention to provide an apparatus and method for training gin saw blades and aligning ginning rib assemblies so that they will be accurately and precisely aligned to each other after they are re-installed in a cotton gin.

It is another object of the invention to avoid the need for trial and error techniques of aligning gin saw blades and ginning ribs that require repeated removal and re-installation of gin saw assemblies and ginning rib assemblies.

SUMMARY OF THE INVENTION

Briefly described, and in accordance with one embodiment thereof, the invention provides apparatus and methods for efficiently adjusting or training a gin saw assembly and a ginning rib assembly used in a cotton gin in conjunction with the gin saw assembly after both have been removed from the cotton gin for servicing, the apparatus including a first mounting element for the gin saw assembly, a template and an adjustable template support for aligning the template to the gin saw assembly so that aligning marks on the template are positioned adjacent to individual gin saw blades to provide a reference for determining if peripheral portions of the gin saw blade are misaligned, a second mount element for the ginning rib assembly, and an adjustment mechanism for moving the gin saw assembly mounting toward the ginning rib assembly so that the individual gin saw blades extend between respective adjacent ginning ribs. In the described embodiment of the invention, the gin saw assembly includes bearings and a bearing support at each end of a shaft on which the individual ginning ribs are installed. The bearing support is bolted to the first mounting element, and the template is moved adjacent to the individual gin saw blades and laterally adjusted to align the template with the gin saw assembly. The gin saw blades are slowly manually rotated, and a training tool and/or shimming techniques are utilized to align the entire periphery of each misaligned gin saw blade with a corresponding alignment mark on the template. The template is then moved away from the gin saw assembly, and the ginning rib assembly is mounted on the second mounting element adjacent to the gin saw assembly. An inclined telescoping mechanism supporting the first mounting element is manually actuated to cause the gin saw blade to pass into the gaps between respective adjacent ginning ribs. Using the prealigned gin saw blades as references, the ginning ribs are adjusted as necessary to cause the gaps therebetween to be moved so that each gin saw blade is centered in a gap between adjacent ginning ribs. The gin saw assembly and ginning rib assembly then are removed from the training apparatus and re-installed in the cotton gin. In the described embodiment of the invention, the telescoping device moves the gin saw assembly into precisely the same relationship with the ginning rib assembly as when both the gin saw assembly and ginning rib assembly are operatively installed in the cotton gin.

In the described embodiment of the invention, a vibrator device is placed in contact with the shaft upon which the gin saw blades and spacers are mounted after the gin saw assembly has been positioned on the first mounting element in order to cause random transverse displacements of the individual saw blades and spacers before a nut forcing the saw blades and spacers of the gin saw assembly together is tightened. This nut is tightened while vibrations are being imparted to the shaft. This procedure prevents the gin saw blade assembly from being slightly off balance due to the fact that the center holes in the gin saw blades and spacers are necessarily slightly larger than the diameter of the shaft.

DESCRIPTION OF THE INVENTION

Figure 1:
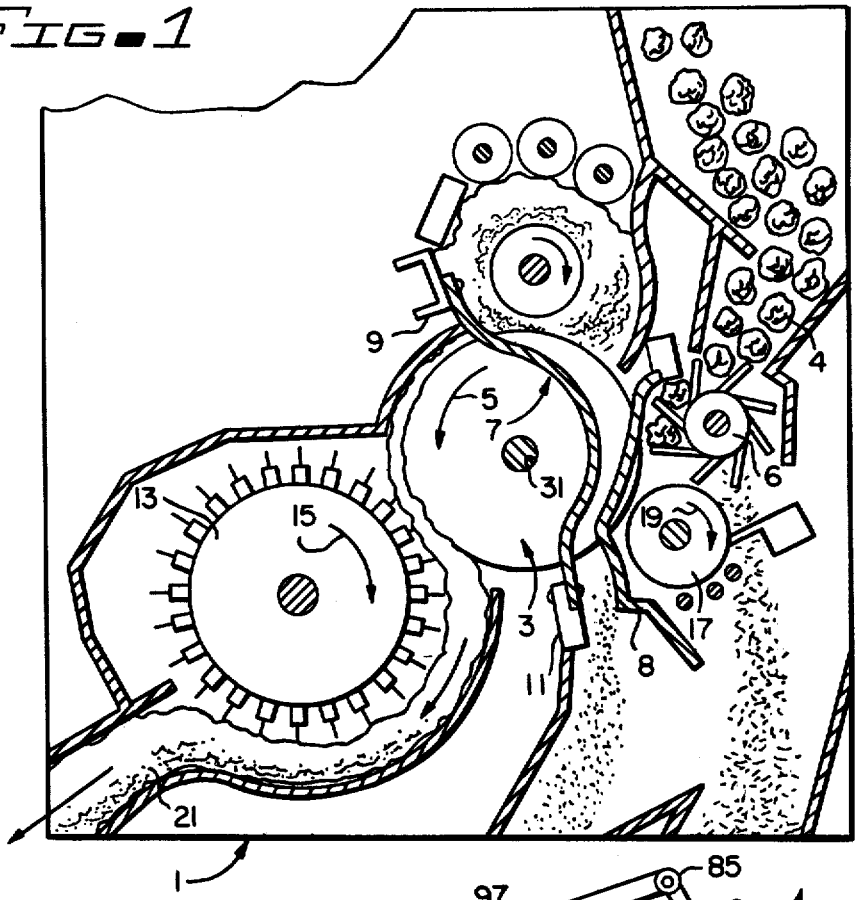
FIG. 1 is a partial section view of a gin saw assembly and a ginning rib assembly in a cotton gin.

First, it will be helpful to briefly describe the structure in operation of a typical cotton gin. Referring to FIG. 1, cotton gin 1 includes a gin saw assembly 3 which includes approximately 128 individual gin saw blades spaced at approximately five-eighths of an inch intervals. The gin saw blades rotate in the direction indicated by reference numeral 5. Incoming cotton 4 is brought into contact with a applicator cylinder 6 that draws cotton past some spaced grating bars and an assembly of spaced huller ribs 8 to remove debris and hulls and into contact with the blades of gin saw assembly 3. Ginning of the cotton takes place as the cotton fibers are snagged by the teeth of gin saw assembly 3 and drawn through the spaced between ginning ribs of a ginning rib assembly 7 to remove cotton seeds. It should be noted that the ginning rib assembly includes a lower rail 11 and an upper rail 9 to which all of the ginning ribs are respectively attached by means of suitable bolts or screws. When the individual blades of gin saw assembly 3 are perfectly aligned with each other and with the individual ribs of ginning rib assembly 7, optimum efficiency of the cotton gin is attained. A maximum amount of cotton is drawn through the spaces between the ginning ribs, and optimum removal of cotton seeds is achieved by the ginning ribs. Ginned cotton then is removed or doffed from the teeth of the blades of gin saw assembly 3 by means of doffer brush cylinder 13, which rotates in the direction indicated by arrow 15. (The peripheral velocity of doffer brush 13 is greater than the peripheral velocity of the teeth of gin saw assembly 3, causing lint cotton 21 to be moved to the outlet of the cotton gin.)

Figure 4:
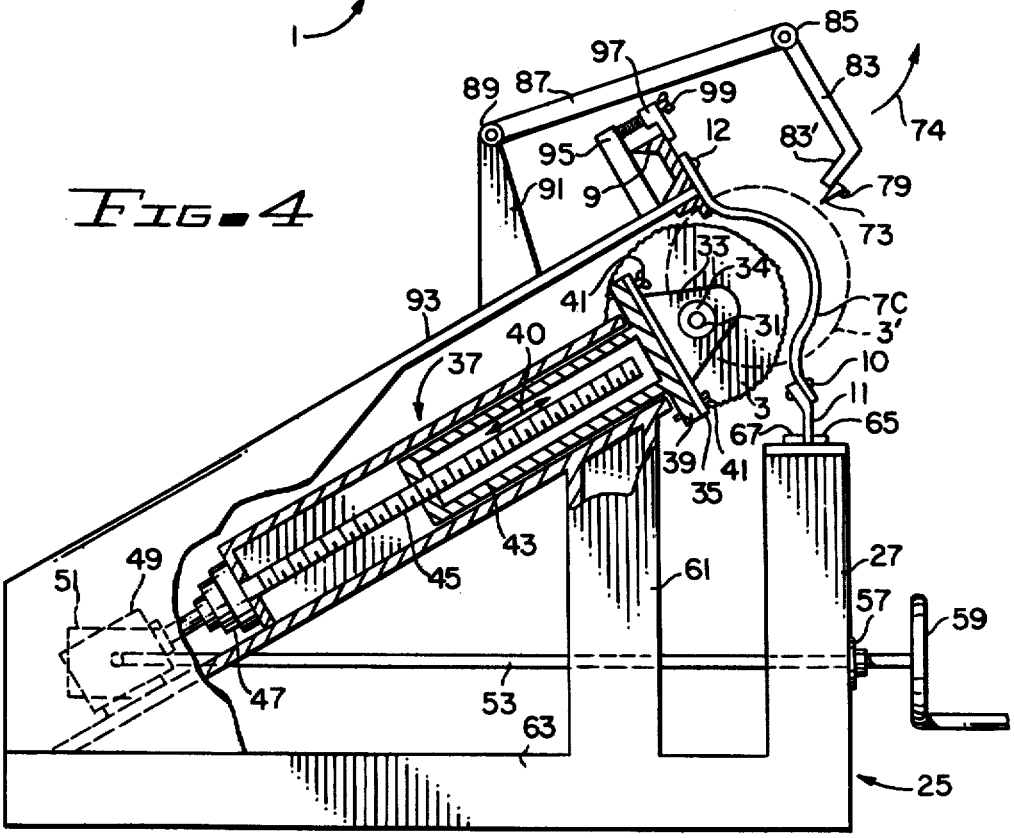
FIG. 4 is a partial cutaway side view of the training apparatus shown in FIG. 2.
Figures 2, 3, 4, 5, 6:
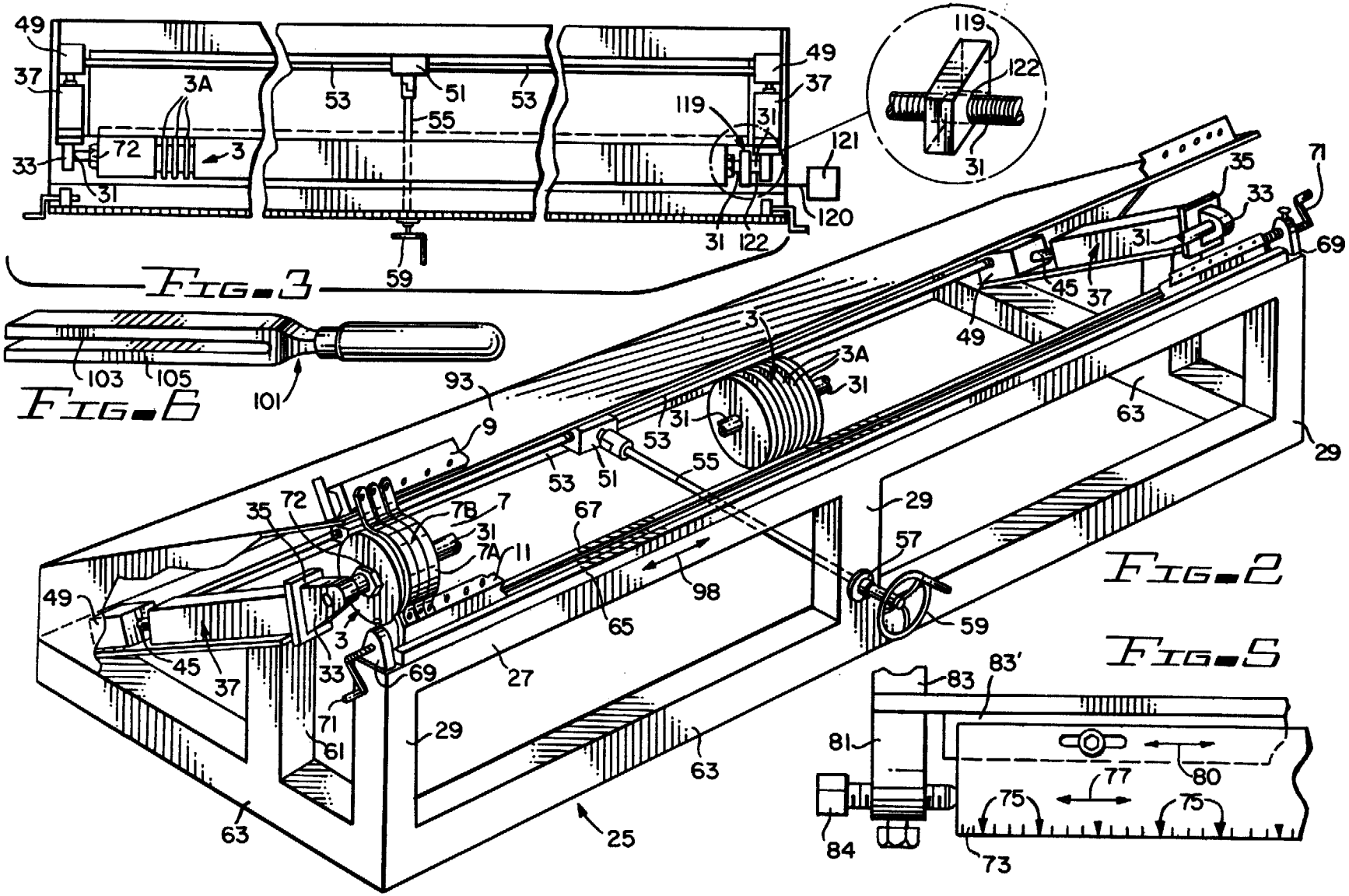
FIG. 2 is a cutaway partial perspective view of the training apparatus of the present invention.
FIG. 3 is a partial top view of the training device of FIG. 2.
FIG. 5 is a partial plan view of the template and lateral adjustment therefore, used in conjunction with the training apparatus of FIG. 2.
FIG. 6 is a side view of a gin saw blade training tool used in conjunction with the method of the present invention.

Referring now to the remaining drawings, particularly FIGS. 2 and 4, gin saw training apparatus 25 includes a base section for supporting both the gin saw assembly 3 and the ginning rib assembly 7 of FIG. 1 when they have been removed from cotton gin 1 (FIG. 1) for servicing. The types of servicing normally required at least once per ginning season include replacing the individual gin saw blades such as 3A, bending or shimming the individual gin saw blades in order to bring them back into their original perfect alignment, and also adjusting the individual ginning ribs so that they are perfectly aligned with respect to the gin saw blades.

The above-mentioned base section includes horizontal front, side and rear base members generally designated by reference numeral 63. As shown in FIGS. 3 and 4, both the gin saw assembly 3 and the ginning rib assembly 7 are mounted on the training apparatus 25. Training apparatus 25 includes an elevated front horizontal member 27 supported on three posts 29 that extend upward from the front base member 63. A pair of guide rails 65 and 67 are rigidly attached to the top surface of horizontal member 27 on which lower rail 11 of ginning rib assembly 7 rests. The space between guide rails 65 and 67 is such that lower rail 11 of ginning rib assembly 7 fits closely between guide rails 65 and 67, and can be laterally adjusted along them.

A pair of lateral adjustment devices 69 are attached to the upper surface of horizontal member 27 at each end thereof to provide precise lateral adjustment of lower rail 11 of ginning rib assembly 7 along the top surface of horizontal member 27. Each of the adjustment devices 69 includes a crank 71 having a threaded shaft that passes through a correspondingly threaded hole in one of the adjustment devices 69 to engage an end of rail 11 in order to facilitate precise lateral adjustment of ginning rib assembly 7 slightly to the right or to the left in order to accurately center the narrow gaps between ginning ribs about the gin saw blades.

The upper rail 9 of ginning rib assembly 7 is clamped in place by means of a clamp assembly including a rigid block 95 that is attached to a stationary cover plate 93. A clamp member 97 has a lip that is extended over the edge of rail 9 after rail 9 is positioned against block 95. A thumb screw 99 passing through clamp member 97 into a threaded hole of block 95 tightens clamp member 97 against upper rail 9, securing it tightly against block 95. Several other similar clamping assemblies (not shown) are provided along the length of upper rail 9. (Note that the upper clamping assembly is omitted from FIG. 2 for clarity of illustration.)

Gin saw assembly 3 includes a bearing housing 33 in which a ball bearing insert 34 is disposed. Shaft 31, on which the above-mentioned 128 spaced gin saw blades 3A are coaxially mounted between spacers, extends through the center of ball bearing insert 34. Bearing housing 33 is rigidly attached to a flat mounting plate 35. Mounting plate 35, and the bearing assembly including bearing housing 33 and ball bearing insert 34 are all included as part of gin saw assembly 3, and all are removed from the cotton gin along with gin saw assembly 3. Of course, a bearing assembly is included at each end of shaft 31.

Plate 35 is bolted to a support plate 39 by means of thumb screws or bolts 41 (FIG. 4). Support plate 39 is attached to the movable end of a telescoping jack 37. Jack 37 has an internal telescoping member 43, the inner end of which includes a threaded hole through which a threaded rotatable shaft 45 extends. The outer end of telescoping portion 43 is rigidly attached to support plate 39. As threaded shaft 45 rotates, telescoping member 43, support plate 39, and therefore gin saw assembly 3, move in one of directions indicated by arrows 40, depending on whether shaft 45 turns clockwise or counter-clockwise.

Jack 37 includes an outer housing portion within which telescoping member 43 slides as shaft 45 rotates. Shaft 45 extends through a bearing unit 47 attached to the bottom end of the housing, and into a right-angle gear box 49.

As best seen in FIGS. 2 and 3, right angle gear boxes 49 are rigidly supported by the base unit, and each receive a horizontal rotating rod 63 at approximately right angles to screw shafts 45. In FIGS. 2 and 5, it can be seen that training apparatus 25 includes two jacks 37, one at each end thereof for supporting the two opposed ends of gin saw assembly 3. Each of the jacks 37 is rigidly installed at approximately a 30° angle relative to the surface on which training apparatus 25 rests. The two rotating horizontal shafts 53 are connected to gears in a double-ended right angle gear box 51 that is driven by shaft 55. Shaft 55 is connected to crank handle 59, which extends beyond the front of training apparatus 25, so the crank handle 59 can be conveniently turned by an operator as he carefully observes the accuracy of the alignment of the gin saw blades with the gaps between the ginning ribs, as subsequently explained. The front portion of shaft 55 extends through a bearing 57 that is supported by the middle post 29.

Referring now to FIG. 4, a template, sometimes referred to as a rib template, and designated by reference numeral 73 is supported on an articulated device including a stationary member 91 attached to the upper surface of cover plate 93, an arm 87 pivotally connected by friction bearing 89 to the upper end of stationary support 91 and an arm 83 pivotally connected by friction bearing 85 to the one end of arm 87. Arm 83 is connected to an inwardly oriented plate 83', to which template 73 is adjustably attached by means of a plurality of set screws 79.

Template 73 is of a type typically supplied by the manufacturer of a cotton gin, and usually is used in the manner previously described herein to adjust or train the gin saw blades of gin saw assembly 3.

Two of the articulated structures shown in the partial cutaway side view of FIG. 4 are provided, one at each end of training apparatus 25 to support the opposed ends of template 73, which extends approximately along the entire length of the gin saw assembly 3. Template 73 can be pivoted away from the periphery of the gin saw blades in a direction indicated by arrow 74 in FIG. 4 in order to facilitate installing of ginning rib assembly 7 after the gin saw blades have been suitably adjusted, as subsequently explained.

The details of template 73 are best seen in FIG. 5, wherein it is seen that a plurality of calibration marks 75 are provided along one edge of template 73. Template 73 is adjustably attached to plate 83', which is supported by the two arms 83 at opposite ends of plate 83'. A plurality of slots 82 are provided in template 73 through which set screws 79 extend and engage threaded holes in plate 83'. Set screw 84 extends through an extension 81 of arm 83 to engage one end of template 73 and thereby facilitate precise lateral movement in one of the directions indicated by arrows 80 in FIG. 5. A similar set screw is provided at the opposite end of template 73 (not shown).

As shown in FIG. 2, a substantial portion of the ginning rib assembly 7 and gin saw assembly 3 have been omitted to allow clarity of illustration of other portions of training apparatus 25. However, several individual gin saw blades 3A are shown extending from gin saw assembly 3 in FIG. 2, and also in FIG. 3A.

The method of utilizing training apparatus 25 will now be described.

First, the entire gin saw assembly 3 and ginning rib assembly 7 are removed from the cotton gin 1 when it is necessary to replace and/or trim or adjust the 128 individual gin saw blades 3A. After replacing or "stacking" the gin saw blades and five-eighths of an inch spaces on the shaft 31, if replacement of the gin saw blades is necessary, the operator places gin saw assembly 3 so that the bearing support plate 35 rests against support plate 39 (FIG. 4), and tightens thumb screws 41 to rigidly attach the gin saw assembly 3 to the upper end of jack 37.

The operator then moves the calibrated edge of the template 73 to within approximately one thirty-second of an inch of the peripheries of the gin saw blades 3A, and deploys set screws 79 and 84 (FIG. 5) so that various ones of the alignment marks 75 are precisely aligned adjacent to the ones of the gin saw blades 3A that are not misaligned. The operator manually rotates the gin saw blades to check the alignment of each gin saw blade relative to the adjacent calibration of marks 75 on template 73. If any portion of a particular gin saw blade is misaligned and need to be bent in one direction of the other, the operator uses the training tool 101 of FIG. 6, and inserts it so that legs 103 and 105 extend on opposite sides of that gin saw blade. The operator then applies force either to the right or the left to bend or "unwarp" a warped portion thereof. In some instances, appropriate thin shims are inserted between the blade surface and one of the above-mentioned spacers engaging the central portion of that gin saw blade after loosening of nut 72 (FIG. 2) enough to make room for the shims between various blades and spacers. The operator laboriously continues this process until he is satisfied that all of the gin saw blades have been properly and precisely adjusted or trained.

Next, the operator moves template 73 out of the way by moving it in the direction indicated by arrow 74 in FIG. 4. The operator then installs the rib cage assembly 7 by placing the lower edge of lower rail 11 between guide rails 65 and 67. The upper rail 9 then rests against stationary block 95, as shown in FIG. 4. Using the lateral adjustment cranks 71 shown in FIG. 2, the operator then precisely laterally adjusts the position of ginning rib assembly 7 in one of the directions indicated by arrows 98 in FIG. 2. In the course of this operation, the operator may turn crank 59 to bring the edges of the gin saw blades 3A close to the individual ginning ribs 7C to facilitate precise lateral positioning of gin rib assembly 7 so that each of the gin saw blades is precisely positioned in the middle of the gaps between ginning ribs that appear to be not misaligned. Next, the operator continues to turn crank 59 until the gin saw blades are all in the position indicated by dotted line 3' in FIG. 4. This position is the same relative to ginning rib assembly as when both gin saw assembly 3 and ginning rib assembly 7 are operatively installed in cotton gin 1, as shown in FIG. 1.

Next, the operator inspects the gaps between the various ginning ribs to determine which ginning ribs are misaligned. The operator then adjusts the position of the misaligned ginning ribs, either by bending them slightly, or loosening and re-tightening screws, such as 10 and 12 (FIG. 4) attaching the ginning ribs to lower rail 11 and upper rail 12, until all of the ginning ribs are positioned so that every gin saw blade 3A is precisely positioned in the middle of the gap between the two adjacent ginning ribs 7C.

At this point, the training operation is complete. The ginning rib assembly 7 and the gin saw assembly 3 are both removed from the training apparatus 25 and reinstalled in cotton gin 1.

It should be noted that the diameters of the certain holes in the individual gin saw blades 3A and the holes in the spacers between the blades are necessarily slightly larger than the diameter of the shaft 31. The tolerance between the holes and the diameter of shaft 31 is typically a few mils. Although this tolerance is small, all of the individual saw blades 3A are offset in the same direction by this amount, the gin saw assembly 3 will be "off balance" enough to cause an unacceptable reduction in efficiency of the cotton gin as the gin saw assembly 3 rotates at normal speeds during ginning operation. In order to avoid the problem, it is common practice to stand the entire gin saw assembly 3 on end before tightening nut 72, strike shaft 31 with a heavy hammer to cause random transverse (relative to the shaft) displacements of the saw blades and spacers on the shaft, and then tighten nut 72. This procedure would be inconvenient when used in conjunction with my new gin saw training apparatus 25 if nut 72 needs to be loosened in order to insert shims, as all of the individual saw blades and spacers might fall into transverse misalignment in the same direction since the shaft 31 is horizontal. It would be inconvenient to then have to remove the gin saw assembly 3 from training apparatus 25, stand it on end, strike shaft 31 with a hammer, tighten nut 72, and again install the gin saw assembly 3 on training apparatus 25. To avoid this, I provide a powerful vibrator device 119 to one end of shaft 31, as shown in FIG. 3, to impart random transverse displacements of the saw blades and spacers on shaft 31 while tightening nut 72. Reference numeral 120 denotes a connection to a source of power, which may be pneumatic or electric, for the operative vibrator element contained in vibrator device 119. A semicircular cutout 122 is provided to effectuate efficient transfer of vibratory energy from device 119 to shaft 31. A variety of suitable operative vibrator elements are commercially available (for example, from Cleveland Vibrator Company).

While the invention has been described with reference to a particular embodiment thereof, those skilled in the art will be able to make various modifications to the disclosed apparatus and method without departing from the true spirit and scope of the invention.

I claim:

1. A method for training a gin saw assembly and a ginning rib assembly used in a cotton gin, said method comprising the steps of:

removing the gin saw assembly and the ginning rib assembly from the cotton gin;

mounting said gin saw assembly onto a first mounting element;

moving a template having a plurality of alignment marks thereon representing proper spacing of individual gin saw blades of said gin saw assembly to a position adjacent to said gin saw blade;

slowly rotating said gin saw blades and comparing the positions of the peripheral portions of each gin saw blade to the position of a corresponding alignment mark on said template and manually training that gin saw blade as necessary to accurately align peripheral portions of that gin saw blade with its corresponding alignment mark;

moving said template away from said gin saw blade;

mounting the ginning rib assembly adjacent to said gin saw assembly onto a second mounting element and aligning the gaps between adjacent individual ginning ribs of the ginning rib assembly with respective ones of the gin saw blades;

moving the first mounting element toward the ginning rib assembly and causing the individual gin saw blades to pass into the gaps between adjacent ginning ribs;

comparing the position of each gin saw blade to the position of the adjacent ginning ribs to determine if that gin saw blade is accurately centered in the gap between the adjacent ginning ribs;

manually adjusting the ginning ribs as necessary to cause the gap to be located so that the gin saw blade is accurately centered in that gap; and removing the gin saw assembly and ginning rib assembly from the first and second mounting elements, respectively, and re-installing the gin saw assembly and ginning rib assembly in the cotton gin.

2. The method of claim 1 wherein said gin saw assembly includes a shaft and two bearing assemblies supporting said shaft, each of said bearing assemblies including a support plate, said mounting of said gin saw assembly including bolting the support plates to the first mounting element.

3. The method of claim 1 wherein said rotating of said gin saw blades is performed manually and said comparing of the positions of each saw blade is performed visually.

4. The method of claim 1 wherein said manual training includes using a bifurcated training tool to bend a portion of the gin saw blade to a more precisely aligned configuration.

5. The method of claim 1 wherein said manual training includes shimming the gin saw blade to align it with an alignment mark of the template.

6. The method of claim 1 wherein said second mounting element is attached to a jack, said moving of the first mounting element including manually operating the jack to extend it.

7. The method of claim 1 wherein said manual adjusting of the ginning ribs includes loosening and retightening screws attaching the ginning ribs to a rail.

8. The method of claim 1 including replacing all of the gin saw blades before said mounting of said gin saw assembly onto the first mounting element.

9. The method of claim 1 including applying vibratory energy to a shaft on which the gin saw blades are installed to impart random transverse displacements of the individual gin saw blades and spacers therebetween during any necessary tightening together of the gin saw blades and spacers on the shaft to cause any misalignments of the individual gin saw blades and spacers to be as random as possible.

* * * * *